US005322227A

United States Patent [19]

Fiocchi

[11] Patent Number: 5,322,227

[45] Date of Patent: Jun. 21, 1994

[54] COMBINATION PULVERIZER AND CLOSURE DEVICE

[76] Inventor: James Fiocchi, 421 Marshaman, Highland Park, Ill. 60035

[21] Appl. No.: 9,275

[22] Filed: Jan. 26, 1993

[51] Int. Cl.[5] ..... B02C 19/08

[52] U.S. Cl. ..... 241/100; 241/169.2

[58] Field of Search ..... 241/100, 169, 169.2, 241/168; 225/96, 96.5; 215/329, 338-340

[56] References Cited

U.S. PATENT DOCUMENTS

| | | | |
|---|---|---|---|
| D. 310,731 | 9/1990 | Lieptz . | |
| 926,327 | 6/1909 | Hoffman . | |
| 963,517 | 7/1910 | Coll | 215/340 |
| 2,274,250 | 2/1942 | Simpkins . | |
| 2,602,596 | 7/1952 | Jones et al. . | |
| 2,655,259 | 10/1953 | Davoren . | |
| 2,726,816 | 12/1955 | Brantley | 241/169.2 |
| 2,892,595 | 6/1959 | Tupper . | |
| 3,815,802 | 6/1974 | Stevens . | |
| 4,159,568 | 7/1979 | Berner . | |
| 4,173,826 | 11/1979 | Leopoldi et al. . | |
| 4,209,136 | 6/1980 | Linden et al. . | |
| 4,348,950 | 9/1982 | Harris . | |
| 4,366,930 | 1/1983 | Trombetti, Jr. . | |
| 4,422,553 | 12/1983 | Hoeks et al. . | |
| 4,765,549 | 8/1988 | Sherman | 241/169.2 X |
| 4,887,755 | 12/1989 | Gibilisco . | |
| 5,118,021 | 6/1992 | Fiocchi . | |

*Primary Examiner*—Douglas D. Watts
*Attorney, Agent, or Firm*—Steven M. Shape

[57] ABSTRACT

A combination pulverizer and container closure device includes a pestle and mortar for crushing tablets, pills and the like, and is adapted to be incorporated within a bottle cap or other container closure. The combination device is adaptable for use in combination with container closures with or without safety lock features.

11 Claims, 3 Drawing Sheets

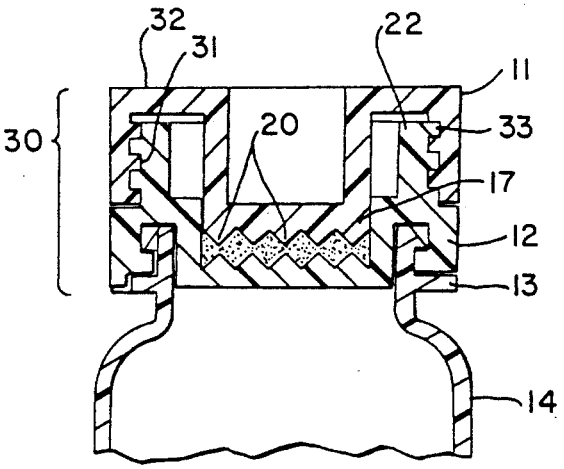
FIG. 5
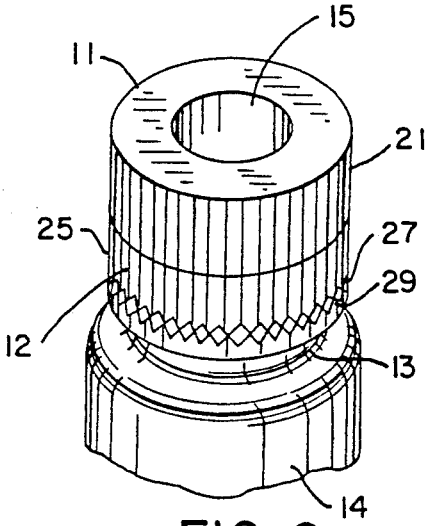
FIG. 6
FIG. 8
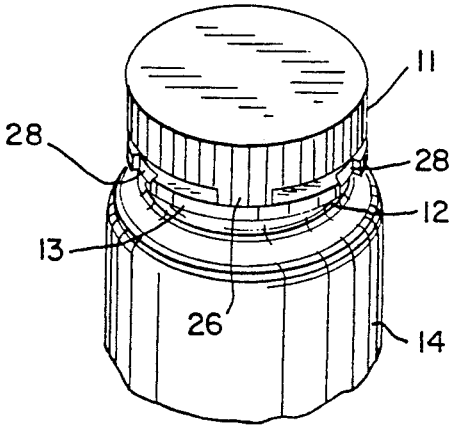
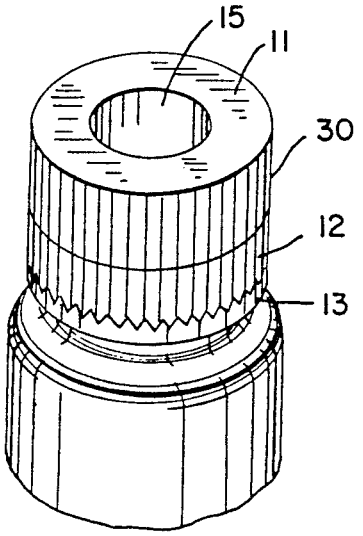
FIG. 7
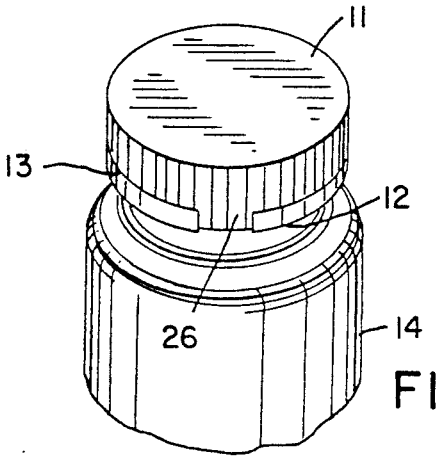
FIG. 9

COMBINATION PULVERIZER AND CLOSURE DEVICE

BACKGROUND OF INVENTION

1. Field of Invention

This invention relates to container closures and in particular, a combination safety closure and pulverizing device designed for containing, storing, conveniently dispensing, and splitting or breaking down solid material such as tablets, pills and the like.

2. Description of the Prior Art

A variety of safety closures have been developed to prevent children from opening containers such as screw-cap bottles, medicine vials and the like. These closures or caps are generally complex, difficult to use and expensive to fabricate. Many require additional elements or moving parts utilized in connection with the closure. Often the prior art is unreliable in operation and becomes ineffective after opening once or twice for the locking elements soon are abraded or worn away. Other safety caps necessitate unduly complicated maneuvers for removal. Some closures require unusual dexterity, and others are too simple and can be forced open by small children, and hence are not acceptable. Moreover, none of the available closures offer a pulverizing device conveniently accessible in combination with the closure or cap.

Similarly, a vast variety of tablet pulverizers and pill splitters are also available. As disclosed in U.S. Pat. No. 4,765,549 issued to R. Sherman and U.S. Pat. No. 5,118,021 issued to J. Fiocchi, many devices provide various means for splitting and breaking down tablets and other similar objects. Yet none are designed with the capability to store substances such as medicine capsules in container closures or bottle caps having safety lock features, particularly safety lock features which are simple to use and manufacture and that provide for easy and effective retrieval of the contents.

Frequently, medication must be administered at a specific time or interval regardless of where a patient is at that time. Medicine is often carried in bottles distributed by the pharmacist designed to be safe from the reach of children and convenient to carry in a purse or pocket. Because many people have difficulty swallowing tablets in whole form, their medication must be broken up. Yet, no prior art bottle cap or container closure offers a convenient mechanism that pulverizes medication without the need for another utensil, avoiding any loss of the prescription or making a mess.

There is a need, heretofore not met, for a device to conveniently contain, store, safety lock, and carry and to easily retrieve and pulverize medicinal substances and the like in bottles or other similar type containers.

SUMMARY OF INVENTION

The subject invention is related to a combination closure device for pulverizing solid objects such as tablets, pills capsules and the like, and is particularly well-suited for use in connection with safety caps used on medicinal bottles distributed by pharmacists and drug companies. The closure of the subject invention includes a material pulverizer as part of a container closure or safety cap which employs a specific snap off design. The snap off design is adaptable for use with a variety of different types of available safety caps. The pulverizer of the present invention utilizes a pestle and mortar assembly that will granulate numerous different tablet sizes and shapes, or other solid substances.

In the preferred embodiment of the invention, the combination container closure device includes a top and a bottom section and means for engaging a flange or a container. The top and bottom sections make up a pestle and mortar for pulverizing solids. When coupled together, these sections form a container closure or cap. The flange is specifically design to receive the bottom section of the closure and hold it in place on the container as solids are pulverized. The top and bottom sections both contain a border or skirt surrounding the outer perimeter of each section. The closure or cap may be designed to snap directly off the flange. The combination pulverizer closure of the present invention may be incorporated with numerous available safety cap designs.

In its preferred form, the top section of the container closure includes a cylindrical cavity having a closed bottom defining a pestle. Similarly, the bottom section includes a tubular chamber defining a mortar. The mortar has a circumference greater than the outer perimeter of the pestle for providing a nested relationship with the pestle. To pulverize solid material, the pestle is positioned within the mortar and rotated. The pestle or mortar may contain and utilize a variety of pulverizing designs, methods or patterns, including that shown in U.S. Pat. No. 4,765,549 issued to R. Sherman. Here, the pestle or mortar, or both, contain protrusions arranged in a pattern of intersecting lines and columns generally of pyramidal shape. The myriad of points enhances the granulation of solids to completely pulverize a tablet. Other designs such as the Tablet Crusher of U.S. Pat. No. 2,602,596 may also be implemented to provide increased efficiency in grinding material.

To affix the top and bottom sections together, a threaded means is located on the exterior of the tubular chamber of the bottom section and couples to a threaded means located in the interior of the skirt of the top section. When the sections are coupled together, the skirts will match up evenly and form the border of the container closure. The exterior of both skirts may be knurled for ease of grasping and turning.

The flange is securely attached to and will accommodate containers utilizing any one of a variety of closures or bottle cap designs, with or without safety lock features. In one preferred embodiment, the flange contains a plurality of gaps that match and register with a plurality of notches contained in the skirt of the bottom section. Upon registering the notches within the gaps, the bottom section is fixed into place relative to the container and will no longer rotate. In this position, the mortar remains stationary during the pulverization of solids and the closure can be simply snapped off the container. The snap off feature of the present invention eases the removal of the safety cap. Moreover, this closure or cap design can be made without a pulverizer or without safety lock features yielding a simple snap off cap.

Alternatively, the flange may contain a plurality of grooves that form a sawtooth like edge operable for registering with plurality of grooves in the skirt of the bottom section. This embodiment will also hold the mortar in place while pulverizing solids.

It is, therefore, an object and feature of the subject invention to provide for a combination container closure and pulverizing device.

It is another object and feature of the invention to provide for a pulverizing device that also functions as a container closure or bottle cap, with or without safety lock features.

It is yet another object and feature of the invention to provide for a combination container closure and pulverizing device that is available with containers holding tablets, pills, capsules and the like regardless of size and/or shape.

It is still another object and feature of the present invention to provide a snap off removal feature adaptable to the available closures and bottle caps with or without safety lock features.

Other objects and features of the invention will be readily apparent from the accompanying drawings and description of the preferred embodiments which follow.

DETAILED DESCRIPTION OF THE DRAWINGS

FIG. 5 is a partial cross sectional view looking in the same direction as FIG. 4 and shows the pulverizer and closure after the tablet has been pulverized.

FIG. 6 is a perspective view of the combination pulverizer and closure device showing a grooved bottom section skirt connected to a grooved flange.

FIG. 7 is a perspective view of the combination pulverizer and closure device shown in FIG. 6, with the grooved bottom section skirt and flange in mated engagement.

FIG. 8 is a partial perspective view of a safety bottle cap of FIG. 1, having a snap off feature.

FIG. 9 is a partial perspective view looking in the same direction as FIG. 8 and showing the plurality of notches fitted within the flange gaps.

DETAILED DESCRIPTION OF THE PREFERRED EMBODIMENTS

Figure 1:
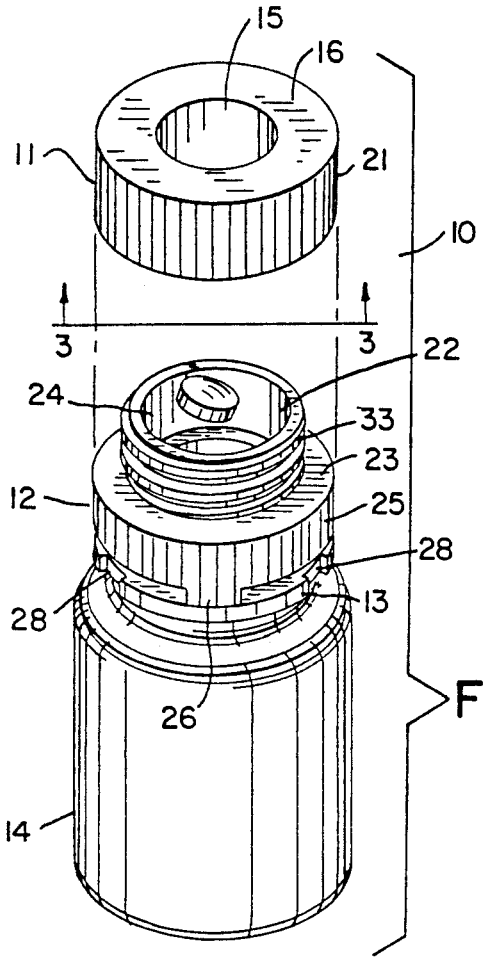
FIG. 1 is an exploded perspective view of the combination pulverizer and closure device of the subject invention.
Figure 3:
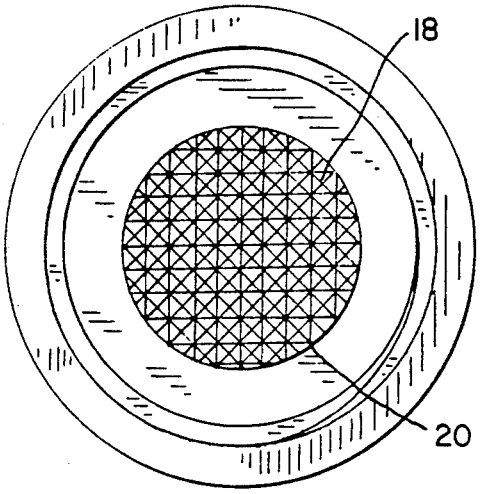
FIG. 3 is a view of the top section of container closure, looking in the direction of arrows 3—3 of FIG. 1 and showing a pestle containing protrusions arranged in a pattern of intersecting lines and columns generally of pyramidal shape.

The preferred embodiment of the combination pulverizer and container closure device made in accordance with the subject invention is illustrated in FIGS. 1-10 and is designated generally by the reference numeral (10). The combination container closure comprises a top section (11), a bottom section (12) and is adapted to be releasably secured to a modified flange (13) on a container (14).

The top section (11) includes cylindrical cavity (15) extending downwardly from a first planar surface (16) having a closed bottom (17) (see FIG. 4) for defining a pestle (18). The pestle (18) has an outer perimeter (19), see FIG. 10. As particularly shown in FIGS. 2-5 and 10, the pestle (18) may contain protrusions (20) arranged in a pattern of intersecting lines and columns generally of pyramidal shape. Different design variations may also be incorporated onto the pestle to improve pulverization of solids. The top section (11) further includes a first outer skirt (21) surrounding the edge of the first planar surface (16). As shown in the drawings, the first skirt (21) may be knurled or grooved for ease of grasping and rotating.

The bottom section (12) contains a tubular chamber (22) intersecting a second planar surface (23) for defining a mortar (24). The circumference of the mortar (24) is greater than the outer perimeter (19) of the pestle (18) for providing a nested relationship with the pestle (18). The bottom section (12) also includes a second skirt (25). The second skirt (25) contains either a plurality of notches (26) (FIG. 1) or plurality of grooves (27) (FIGS. 6 and 7) located at the bottom of the second skirt (25) for securing the bottom section (12) to the flange (13). Correspondingly, the flange (13) contains either a plurality of gaps (28) (FIGS. 1 and 2) that register with the plurality of notches (26) of the second skirt (25), or a plurality of grooves (29) matching with the grooves (27) of the second skirt (25) (FIGS. 6 and 7). Either embodiment will lock the bottom section (12) onto the flange (13) and hold the mortar (24) stationary as solids are pulverized by turning the pestle (18).

As with the first skirt (21) of the top section (11), the second skirt (25) of the bottom section (12) may also be knurled for ease of grasping and rotating.

Figure 4:
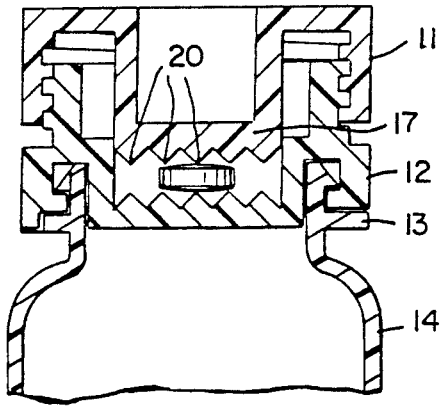
FIG. 4 is a partial cross sectional view of the combination pulverizer and closure device, showing a tablet positioned between the pestle and the mortar.
Figure 2:
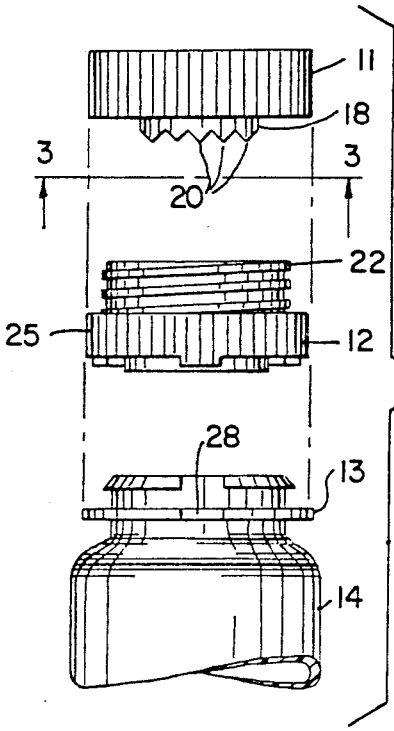
FIG. 2 is a side view of the combination pulverizer and closure device showing the flange gaps and a safety cap attachment.
Figure 10:
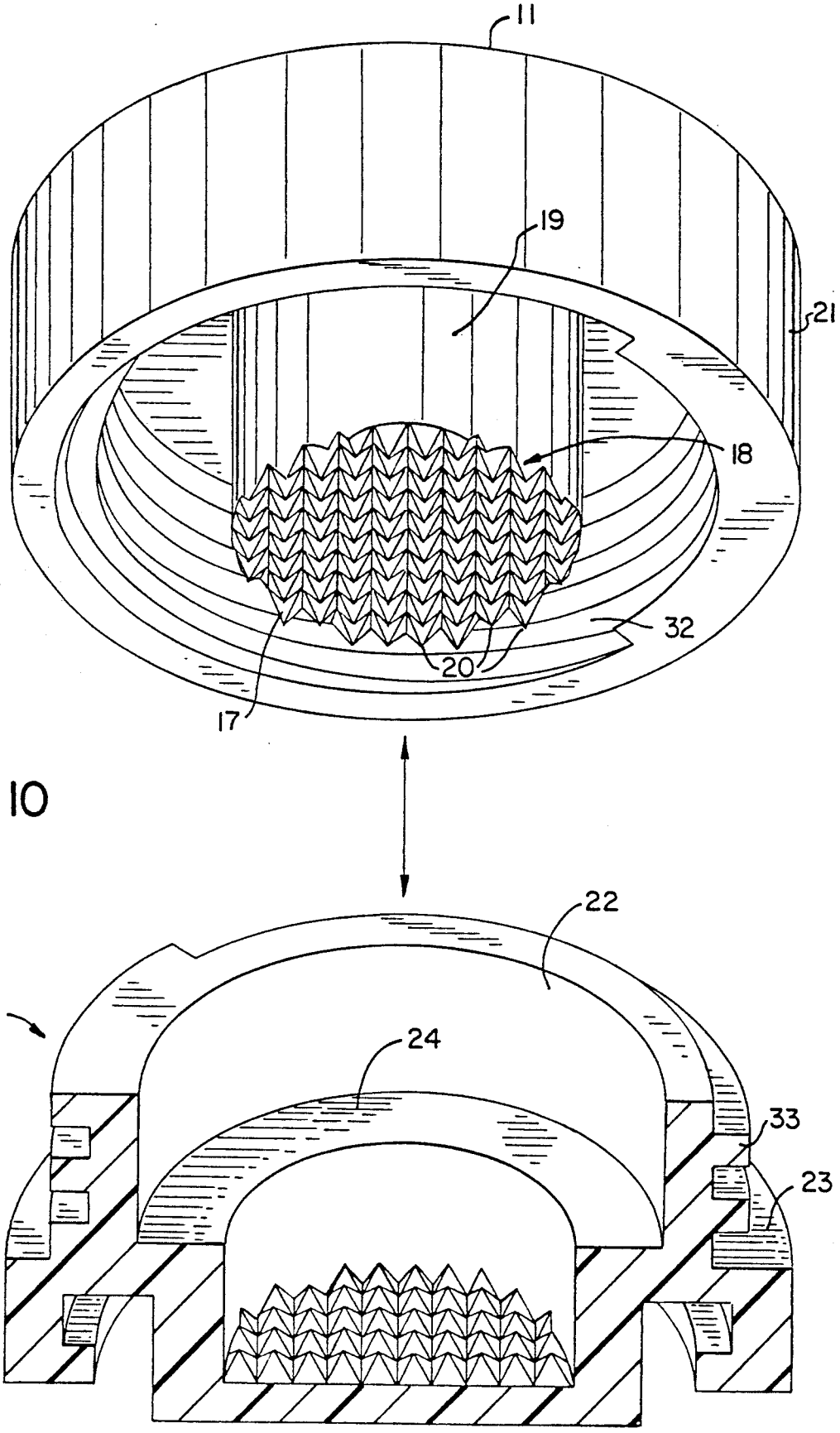
FIG. 10 is an enlarged exploded perspective view of the combination pulverizer and container closure better showing the pestle and mortar containing protrusions arranged in a pattern of intersecting lines and columns generally of pyramidal shape.

To pulverize tablets or other solids, a pill or other the solid material is removed from within the container (14) and placed inside the mortar (24). As illustrated in FIG. 4, the pestle (18) then is placed inside the mortar (24). By pressing down and axially turning the top section (11), the pestle (18) is rotated within the mortar (24) and the solids are crushed. Here, the bottom section (12) simultaneously locks into place on the flange (13).

A container closure (30) (FIG. 5) is formed by coupling a threaded mechanism (31) located in the interior (32) of the first skirt (21) of the top section (11) to a threaded mechanism (33) located on the tubular chamber (22) of the bottom section (12). Regardless of the type of safety lock feature employed, when the notches (26) of the second skirt (25) of the bottom section (12) register within the gaps (28) of the flange (13) the container closure (30) may be directly snapped off the container (14). Snap off removal of the closure (30) may be adapted to a closure or bottle cap, with or without safety lock features, and with or without the combination pulverizer.

While certain features and embodiments of the invention have been described in detail herein, it will be understood that the invention encompasses all enhancements and modifications within the scope and spirit of the following claims.

What is claimed is:

1. A combination pulverizer and container closure device for use in covering a container, comprising:

a top section having a cylindrical portion extending from a first planar surface and a first peripheral skirt surrounding said first planar surface, said cylindrical portion having a closed end forming a pestle, said pestle having an outer perimeter, said first skirt having a first interior and a first exterior;

a bottom section having a tubular chamber in a second planar surface for forming a mortar and a second peripheral skirt surrounding said second planar surface, said mortar having an interior circumference greater that said outer perimeter of said pestle, said second skirt having a second interior and a second exterior, said pestle and said mortar form a nested relationship whereby movement or rotation of said pestle relative to said mortar will facilitate crushing of a solid material placed therebetween; and means for securing the bottom section to a flange on the container.

2. The device of claim 1, wherein said mortar further comprises a peripheral threaded mechanism and said first interior of said first skirt further comprises an internal thread mechanism for coupling said bottom section said to said top section and forming therewith a container closure removably mounted on the flange of the container.

3. The device of claim 2, wherein said first exterior and said second exterior are knurled for ease of grasping said top and bottom sections, respectively.

4. The device of claim 2, wherein said flange further includes a plurality of radially spaced gaps wherein said second peripheral skirt further comprises a plurality of notches operable to register within said gaps of said flange for locking said bottom section in place upon rotation of said bottom section.

5. The device of claim 2, wherein said flange further comprises a first plurality of grooves forming a sawtooth like edge and wherein said second peripheral skirt further comprises a matching plurality of grooves operable to register said plurality of grooves of said flange for locking said bottom section in place upon rotation of said bottom section.

6. The closure device of claim 1, further comprising a plurality of protrusions formed on at least one of said pestle and said mortar projecting toward the other of said pestle and said mortar, said protrusions are arranged in a pattern of intersecting lines and columns and are generally pyramidal shapes defining a myriad of points for pulverizing material, said lines of said protrusions in said pattern are generally perpendicular to said columns of said protrusions.

7. A combination pulverizer and container closure for use with a flanged container comprising:

a top section having a cylindrical cavity extending from a first planar surface and a first peripheral skirt surrounding said first surface, said cylindrical cavity having a closed bottom forming a pestle, said pestle having an outer perimeter, said first skirt having a first interior, a first exterior and an internal thread mechanism;

a bottom section having a tubular chamber intersecting a second planar surface for forming a mortar and a second peripheral skirt surrounding said second surface, said second peripheral skirt having a second interior and a second exterior, said mortar having a peripheral threaded mechanism for coupling with said internal threaded mechanism of said first skirt of said top section forming a container closure, said mortar further having an interior circumference greater than said outer perimeter of said pestle whereby said pestle and said mortar form a nested relationship whereby movement or rotation of said pestle relative to said mortar facilitates the crushing of a solid material placed therebetween;

a plurality of protrusions formed on at least one of said pestle and said mortar projecting toward the other of said pestle and said mortar, said protrusions are arranged in a pattern of intersecting lines and columns and are generally pyramidal shapes defining a myriad of points for pulverizing material, said lines of said protrusions in said pattern are generally perpendicular to said columns of said protrusions; and means for releasably securing the bottom section to a flange on the container.

8. The device of claim 7, wherein said flange comprises a plurality of radially spaced gaps and said second peripheral skirt further comprises a plurality of notches operable to register within said gaps of said flange for locking said bottom section in place upon rotation of said bottom section relative to said flange.

9. The device of claim 7, wherein said flange comprises a first plurality of grooves forming a sawtooth like edge and said second peripheral skirt further comprises a matching plurality of grooves operable to register said first plurality of grooves of said flange for locking said bottom section in place upon rotation of said bottom section.

10. The device of claim 1 wherein said means for securing the bottom section to a flange on the container includes means for removably securing the bottom section to a flange on the container.

11. The device of claim 1 wherein said means for securing the bottom section to a flange on the container includes mean for thredably securing the bottom section to a complementary threaded flange on the container.

* * * * *